US010760330B2

(12) United States Patent
Mirzeabasov et al.

(10) Patent No.: US 10,760,330 B2
(45) Date of Patent: Sep. 1, 2020

(54) FIRE-BLAST RESISTANT DOOR ASSEMBLY AND METHODS FOR INSTALLING THE SAME

(71) Applicants: Timur Akhmedbekovich Mirzeabasov, Saint Petersburg (RU); Dmitriy Olegovich Belov, Saint Petersburg (RU)

(72) Inventors: Timur Akhmedbekovich Mirzeabasov, Saint Petersburg (RU); Dmitriy Olegovich Belov, Saint Petersburg (RU)

( * ) Notice: Subject to any disclaimer, the term of this patent is extended or adjusted under 35 U.S.C. 154(b) by 143 days.

(21) Appl. No.: 15/758,099

(22) PCT Filed: Sep. 6, 2016

(86) PCT No.: PCT/RU2016/000607

§ 371 (c)(1),
(2) Date: Mar. 7, 2018

(87) PCT Pub. No.: WO2017/044005

PCT Pub. Date: Mar. 16, 2017

(65) Prior Publication Data

US 2018/0245398 A1 Aug. 30, 2018

(30) Foreign Application Priority Data

Sep. 7, 2015 (RU) ..... 2015137921

(51) Int. Cl.
*E05G 1/00* (2006.01)
*E06B 5/12* (2006.01)
*E06B 5/16* (2006.01)

(52) U.S. Cl.
CPC ..... *E06B 5/12* (2013.01); *E05G 1/00* (2013.01); *E06B 5/16* (2013.01); *E06B 5/164* (2013.01)

(58) Field of Classification Search
CPC ... E06B 5/12; E06B 5/164; E06B 5/16; E05G 1/00; E05G 1/024; E05G 1/026
(Continued)

(56) References Cited

U.S. PATENT DOCUMENTS 317,688 A * 5/1885 Tripp ..... A62C 3/00 109/26
1,623,155 A * 4/1927 Bellamore ..... E05G 1/04 109/65

(Continued)

FOREIGN PATENT DOCUMENTS

EP 1532343 B1 4/2010
FR 2870880 A1 * 12/2005 ..... E06B 5/12

(Continued)

*Primary Examiner* — Suzanne L Barrett
(74) *Attorney, Agent, or Firm* — Arent Fox LLP; Michael Fainberg

(57) ABSTRACT

A fire-blast resistant door assembly comprises a door frame and a door leaf. The front part of the door leaf comprises a front panel and a front stiffener that delimits a cavity from the inside of the front panel, wherein a sheet refractory material is installed in said cavity. The rear part of the door leaf comprises a rear panel and a rear stiffener that delimits a cavity from the inside of the rear panel. A support structure made of metal is installed in said cavity. The front and the rear parts of the door leaf are mutually connected through the layer of the refractory material, forming the thermal break therebetween, so that said support structure abuts against said sheet refractory material. The door frame, in its turn, comprises a front part and a rear part mutually connected through a layer of the refractory material forming a thermal break.

13 Claims, 3 Drawing Sheets

(58) Field of Classification Search
USPC ..... 109/65, 75–85
See application file for complete search history.

(56) References Cited

U.S. PATENT DOCUMENTS 2,064,005 A * 12/1936 Hughes ..... C10J 1/213 48/80
2,181,466 A * 11/1939 Shackett ..... E04C 5/06 52/660
2,552,515 A * 5/1951 Bremer ..... E05G 1/024 109/77
4,178,859 A 12/1979 Seiz et al.
4,926,761 A * 5/1990 Haesebrouck ..... E05G 1/024 109/49.5
5,060,582 A * 10/1991 Salzer ..... E06B 5/10 109/49.5
5,660,021 A * 8/1997 Wolgamot ..... B32B 7/02 52/783.12
7,000,550 B1 * 2/2006 Mandall ..... E06B 9/00 109/1 S
7,520,205 B1 * 4/2009 Colliflower ..... F41H 5/0421 109/80
8,424,473 B1 * 4/2013 Mandall ..... F42D 5/045 109/26
2002/0095885 A1 * 7/2002 Sampson ..... E06B 5/106 52/202
2003/0208970 A1 11/2003 Saelzer
2007/0193220 A1 * 8/2007 Daniels ..... E06B 3/7015 52/784.11
2014/0000193 A1 * 1/2014 Daniels ..... E06B 3/822 52/232
2018/0245398 A1 * 8/2018 Mirzeabasov ..... E06B 5/12

FOREIGN PATENT DOCUMENTS

RU 41755 U1 11/2004
RU 112250 U1 1/2012
RU 2474665 C1 2/2013
RU 2488677 A 5/2013
UA 42012 U 6/2009

* cited by examiner

FIRE-BLAST RESISTANT DOOR ASSEMBLY AND METHODS FOR INSTALLING THE SAME

CROSS-REFERENCE TO RELATED APPLICATIONS

This application is a National Stage of International Application No. PCT/RU2016/000607, filed Sep. 6, 2016, which claims priority to Russian Patent Application No. 20150137921, filed Sep. 7, 2015, both of which are hereby incorporated by reference in their entireties.

FIELD OF THE INVENTION

The present invention relates to fire-blast resistant assemblies and, in particular, to a fire-blast resistant door assembly for protecting door openings in industrial and specialized facilities against the effects of air blast and open fire, as well as to methods for installing said fire-blast resistant assembly in door openings.

DESCRIPTION OF THE RELATED ART

Known from the prior art is a fire-proof door assembly described in document RU 2488677 C1 (published on Jul. 27, 2013), comprising a door leaf consisting of a metallic framework and an external lining with a material having high thermal resistance and mechanical strength, disposed therebetween. The latter may be, for example, a double-layered aluminosilicate felt, whose layers are separated by a noncombustible reinforced mesh, for instance, from glass fabric or graphite fibers. The entire surfaces of felt, glass fabric and metallic structure are covered with a glue-like mixture of hot-melt glue.

Indeed, this technical solution consisting in equipping the door assembly with such component as a metallic frame, and in introducing to the internal part of the assembly different materials that prevent the fire from spreading, allows to resist the affecting factors of the fire, and to ensure the compliance of said door assembly with specified fire-resistance ratings. However, the structure of said door is not able to withstand the effecting factors of the explosion, i.e. it is not blast-resistant.

From the prior art known is a protective pressurized door described in document RU 2474665 C1 (published on Feb. 10, 2013), comprising a metallic framework that includes a protective metallic sheet fastened thereon and being convex outwards from the door and a central sheet fastened on said framework from its inside. This known door is equipped with a drive mechanism for the wedges, fixed on the central sheet, between the latter and the external protective sheet, and having a manual drive in the form of handwheels arranged on both sides of the door leaf. Some side stops are attached on one side of the door frame, wherein the side end faces of the convex sheet abut against these side stops, and there are other side stops attached on the other side of the door frame, which interact with the locking wedges. When the door is exposed to an air blast, the load from the end faces of the protective sheet is transferred to the door frame stops, substantially relieving the structural elements of the door leaf and reducing the risk of their bending and titling. Said door when assembled is installed in a potential opening of the building wall and only after this step the wall is casted or laid.

The technical solution described in RU 2474665 C1, ensuring stronger connection between the frame and the shelter wall, allows to achieve essentially higher door resistance to severe impact loads affecting this known construction during the explosion. However, the known method used herein for installing the door assembly in the opening before casting or laying the walls is labor- and time-consuming and imposes strict constraints on the opening and the room where said assembly is to be installed, as a whole. Moreover, the drawbacks of this technical solution are low discharge rate and need for exerting considerable efforts to open the door equipped with the mechanism of handwheel locking.

In order to solve the problem of withstanding the effects of the explosive blast by restraining and retarding the blast effects, document US 20030208970 (published on Nov. 13, 2013) proposes to use blast-resistant structure which, for example, can be a door or a window. A mounting part of this structure is received in a space between two counter-support surfaces formed by a U-channel or opposite L-members that protrude perpendicularly to frame surface defining the opening in the wall. A U-sectional profiled member is arranged in said channel and has mounting brackets or plates distributed in the longitudinal direction and welded to this member. Said mounting brackets or plates, in turn, are anchored to a masonry wall by means of bolted connections, the bolts of which extend perpendicularly to the surfaces defining the opening. On one or both sides, a respective damping element is interposed between the mounting part and respective adjacent counter-support surface. The damping element may be a plastically deformable metallic strip. When an explosion force acts on the structure, the damping element is first plastically deformed to absorb energy, before the remaining force is transmitted into the building wall. The two damping elements on opposite sides damp forces from pressure waves of the explosion.

The technical solution described in US 20030208970 B2 is the closest prior art to the present invention and is chosen as its prototype. However, said known structure has the following serious shortcomings. When the known structure is affected by the explosive blast, the developed excessive pressure, in bolted connections anchoring the mounting brackets or plates to the wall with the opening, causes shearing and collapsing transverse stresses critical for such point anchorages. This leads to essential decreasing of blast resistance of the structure installed in the opening. Moreover, this known structure is designed for protecting against the blast effects, the major one being the excessive pressure of the air blast, but not for protecting against the effects of fire, the major one being the thermal radiation.

Therefore, there is a need for providing a fire-blast resistant door assembly that would eliminate the drawbacks of the prior art and ensure the protection both against the blast affecting factors and the affecting factors of fire, as well as for providing simple and effective methods for installing such a fire-resistant door assembly essentially in any door opening.

SUMMARY OF THE INVENTION

The object of the present invention is to provide a door assembly that exhibits both fire resistance and blast resistance properties, and ensures high discharge rate of the door, i.e. not requiring considerable efforts to be exerted for opening the door for personnel passage. Moreover, the object of the present invention is to provide simple and effective methods for installing said assembly essentially in any door opening so as to improve the fire-blast resistance properties of this door due to the features of the fastening systems that do not require excessive time and labor costs, and do not impose strict constraints on the opening for installing said assembly.

The technical result, achievable by the present invention, consists in enhancing the reliability degree and resistance of the door assembly against the effects of the explosive blast, and in ensuring fire resistance of said assembly for a long period of time, such as after air-blast action, without sacrificing the structural integrity and functionalities, in particular, capability for opening the door. Moreover, by implementing the methods for installing the fire-blast resistant door assembly according to the present invention it is possible to install the fire-blast resistant door assembly essentially in any door opening and, at the same time, to simplify the installation procedure and improve the fire and blast resistance properties of thus installed assembly.

The task indicated in the present invention, as regards ensuring the blast resistance of the door assembly, is solved by specifically developed structural features of the door leaf, particular frame and fastening manner. In turn, the aim of ensuring the fire resistance is achieved by using the refractory materials in said assembly, providing a thermal break between external and internal elements of the assembly, and by other features of the door assembly and the methods for installing the same.

More precisely, the indicated aim is achieved due to the fact that the fire-blast resistant door assembly according to the present invention comprises a door frame made of metal and designed to be installed in a door opening, and a door leaf pivotally hinged in the door frame and having a front part and a rear part, and is characterized in that the front part of the door leaf comprises a metallic front panel and a front stiffener extending along the perimeter of the internal side of the front panel so as to form a closed loop that delimits a first mounting cavity, and a sheet refractory material disposed in the first mounting cavity, the rear part of the door leaf comprises a metallic rear panel and a rear stiffener extending along the perimeter of the internal side of the rear panel so as to form a closed loop that delimits a second mounting cavity, and a metallic support structure mounted in the second mounting cavity, wherein the front and the rear parts of the door leaf are mutually connected by fastening the front and the rear stiffeners to each other such that said support structure abuts against said sheet refractory material, a layer of the refractory material is interposed between the front and the rear stiffeners, wherein said layer forms a thermal break between the front and the rear parts of the door leaf, and the door frame comprises a front part and a rear part, mutually connected through the layer of the refractory material, forming the thermal break therebetween.

In a preferred embodiment of the present invention, said sheet refractory material is mineral basalt wool, and the refractory material forming the thermal break in the door leaf and the door frame, is mullite silica cardboard. The usage of said refractory materials improves the fire safety of the door assembly, and due to the fact that the mineral basalt wool disposed in the internal layer of the assembly is a porous material, it is possible to achieve effective blast energy dissipation in said internal layer of the door.

In a preferred embodiment of the present invention said support structure is a grid made of horizontal and vertical elements, said horizontal and vertical grid elements preferably being hollow pipe sections with rectangular cross-section. By making the support structure in the form of the grid that creates a distributed support surface for the sheet refractory material it is possible to maximize the rigidity of the whole door assembly.

In addition, according to this embodiment, said grid of the support structure has a constant vertical and/or horizontal spacing.

In another preferred embodiment of the present invention, the front and the rear stiffeners of the door leaf are fastened together by means of a given number of bolted connections. The number of bolted connections and/or the material of the bolts in said connections are defined so that the thermal effect, defined by specification, on the external part of the door assembly essentially is fully dissipated in its interior.

In yet another embodiment of the present invention the front panel of the door leaf is bigger, along its length and width, than the opening of the door frame and comprises a sealing element mounted along the perimeter of its internal edge and providing a sealing between the door leaf and door frame in the door's closed position. The sealing element may be comprised of rubber or other suitable elastic material capable of providing a sealing.

In an alternative embodiment of the present invention, the front panel of the door leaf may substantially have the same dimensions as the opening of the door frame, whereas additional metallic strips with sealing elements may be welded along the perimeter thereof, superimposing on the door frame in the door's closed position in order to provide the same sealing as in the previous embodiment.

The specified task in regards of providing simple and effective method for installing the door assembly as described above and enhancing the fire and blast resistance properties of the door is solved by a method for installing said fire-blast resistant door assembly in the door opening with a metallic casing, said method comprising the following steps:

welding a first clamping frame made of a metallic angular profile to the casing of the door opening so that one of the profile flanges bears against the casing, while the other profile flange forms a support lug protruding inside the door opening, installing the door frame with the door leaf in the door opening so that it abuts against said support lug, and welding a second clamping frame made of a metallic angular profile to the casing of the door opening so that one of the profile flanges bears against the casing, while the other profile flange forms a closure lug protruding inside the door opening, the door frame being fixed between said support and closure lugs, wherein during the installation of the door frame, a layer of the refractory material is interposed between the latter and said support and closure lugs, wherein said layer forms a thermal break therebetween.

Moreover, said task is completed by a method for installing the above described fire-blast resistant door assembly in the door opening having smaller sizes than the door frame of said assembly, said method comprising the following steps:

welding a support frame made of an angular profile to the exterior perimeter of the door frame so that one of the profile flanges extends at a distance from the door frame surface on the inside of the door and is directed inwards the door opening, so as to form a groove between said flange and the door frame, putting the door frame against the wall essentially so that said profile flange of the door frame, protruding on the inside of the door frame with formation of the groove, abuts against the wall around the door opening, mounting channel-shaped metallic fastening elements on the end faces of the door opening, at least from the upper and lateral sides of the opening, so that the wall of each of said channels essentially bears against the respective end face of the opening, wherein one of the flanges encloses the wall of the opening from the inside, while the other flange is fitted into said groove formed by the profile flange of the support frame and the internal side of the door frame, wherein a layer of the refractory material forming a thermal break is interposed between the wall of the opening and the surfaces of said channel flanges and of the support frame, adjoining each other in the region of said groove, and welding said channel-shaped fastening elements together.

In a preferred embodiment of the method for installing the fire-blast resistant door assembly in the door opening having smaller sizes than the door frame of said assembly, the channel-shaped metallic fastening elements mountable on the end faces of the door opening consist of two angular profiles and at least one strip designed for connecting said profiles and welded thereto.

The methods for installing the door assembly in the door openings according to the present invention allow to enhance the fire and blast resistance properties of the door by using the specifically developed features of the fastening systems that do not comprise the point bolted connections with a bolt arranged transversally to the direction of the air blast exerted on the door. The blast pressure on thus installed door assembly causes only longitudinal collapsing or shearing stresses in welded connections. The strength margin in such welded connections is much higher than the strength of the point connections against the transverse shearing action.

Concurrently, thanks to the present invention it is possible to install the door assembly essentially in any door opening, in particular, in relatively small and unequipped door openings, where the installation of traditional blast resistant doors is impossible. The latter advantage is provided by creating a mounting contour for the door frame, made by the support frame, with the dimensions exceeding the door frame dimensions. The possibility of creating this specific support frame essentially removes all requirements for equipping the door opening for installing the fire-blast resistant doors.

Thus, the methods for installing the fire-blast resistant door assembly according to the present invention enhance the fire and blast resistance properties of this assembly, do not require excessive time and labor costs and do not impose strict constraints on the opening for installing the assembly.

Moreover, it is apparent that, in terms of the usage, the fire-blast resistant door assembly according to the present invention is similar to the traditional door, it does not require exerting considerable efforts to open and close the door for personnel passage and, therefore, it ensures high discharge rate of the door.

Therefore, the set of features of the present invention in each of its embodiments, described above and specified in the claims of the invention, allows the mentioned technical result to be achieved.

BRIEF DESCRIPTION OF THE DRAWINGS

The above-mentioned advantages of the present invention will be better understood from reading the following description of preferred embodiments thereof with reference to the appended drawings, in which.

DETAILED DESCRIPTION OF PREFERRED EMBODIMENTS OF THE INVENTION

Hereafter, with reference to the accompanying drawings described is a fire-blast resistant door assembly, as well as methods for installing the same according to the preferred embodiments of the present invention.

Figure 1:
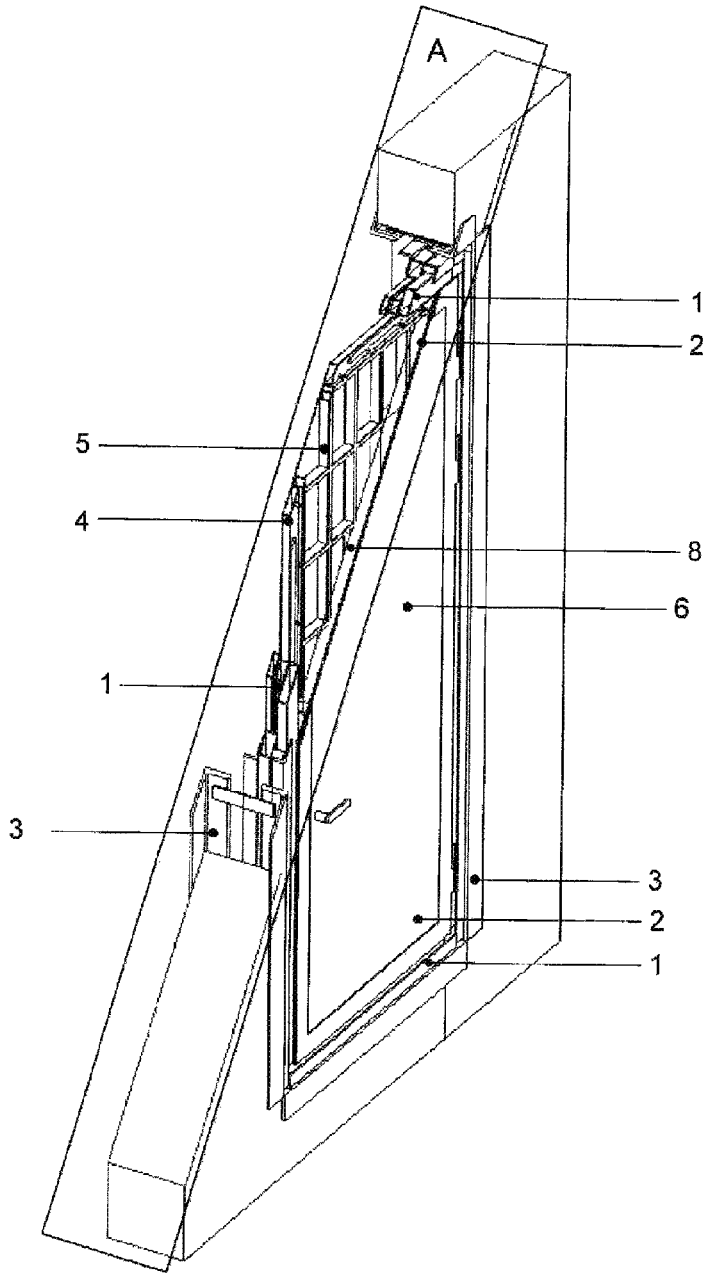
FIG. 1 shows a cutaway view of a fire-blast resistant door assembly installed in a door opening with a metallic casing according to an embodiment of the present invention.
Figure 2:
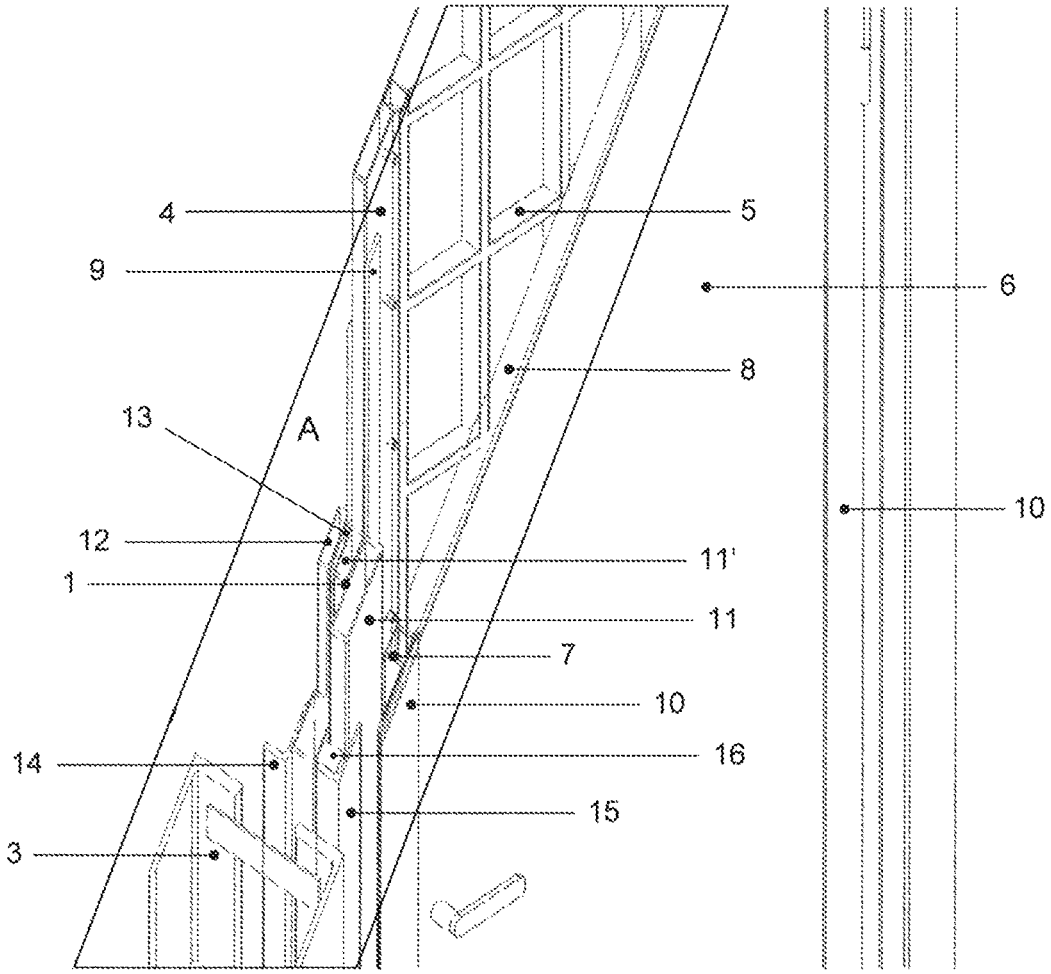
FIG. 2 shows an enlarged segment of the fire-blast resistant door assembly from FIG. 1.

FIG. 1 schematically illustrates the section with the set of planes parallel to the plane A, of the fire-blast resistant assembly comprising a door frame (1) and a door leaf (2), which is installed in a door opening with a metallic casing (3). FIG. 2 shows the enlarged detail of the fire-blast resistant door assembly. The door leaf (2) is a structure consisting of a rear part and a front part. The rear part of the door leaf (2) comprises a metallic rear panel (20, see FIG. 3), wherein a rear stiffener (4) is welded along the perimeter of this panel, said stiffener being made of hollow pipe sections with rectangular cross-section and forming a closed loop that delimits a mounting cavity. In this cavity, hereinafter referred to as the second mounting cavity, a support structure (5) comprised of metal is installed; this support structure represents a grid consisting of horizontal and vertical elements. In turn, said grid elements preferably may be the hollow pipe sections with rectangular cross-section.

Next, as shown in FIG. 2, the front part of the door leaf (2) comprises a metallic front panel (6), wherein a front stiffener (7) is welded along the perimeter of this panel, said stiffener preferably being made of hollow pipe sections with rectangular cross-section and forming a closed loop that delimits a mounting cavity. In this cavity, hereinafter referred to as the first mounting cavity, a mat of sheet refractory material (8), preferably, of a mineral basalt wool, is disposed.

As noted above, in the preferred embodiment the stiffeners (4, 7) of the door assembly are made of hollow pipe sections with rectangular cross-section, thereby ensuring the lightweight of the assembly. However, the present invention is not limited in this respect, and said stiffeners may be, for example, made of pipe sections with nonrectangular section, or they may be solid.

Figure 3:
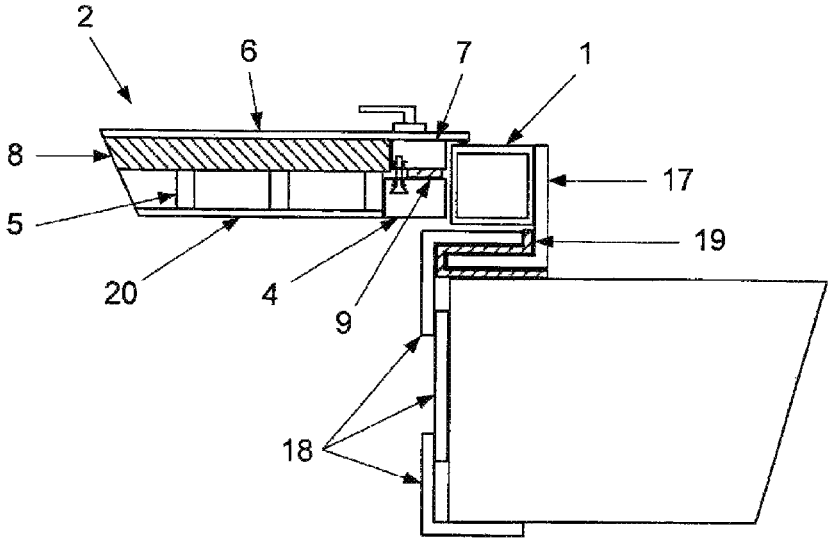
FIG. 3 shows a schematic cross-section view (top view) of the fire-blast resistant door assembly installed in the door frame having smaller dimensions than the door frame of said assembly according to the embodiment of the present invention.

As can be seen in FIG. 2 or FIG. 3, the front and the rear parts of the door leaf (2) are mutually connected by fastening the front (7) and the rear (4) stiffeners to each other by means of a given number of bolted connections so that the support structure (5), with its surface facing outwards, bears against the sheet refractory material (8) and abuts against it. Meanwhile, between said front (7) and the rear (4) stiffeners there is a layer of refractory material (9), preferably of mullite silica cardboard, that creates a thermal break between the front and the rear parts of the door leaf.

The door leaf (2) is pivotally hinged in the door frame, the hinges being preferably installed outside of the door via a welding connection with the door leaf (2) and the door frame (1), respectively. The front panel (6) of the door leaf may be bigger, along its length and width, than the opening of the door frame and may be equipped with a sealing element installed along the perimeter of its internal edge. Therefore, the front panel (6) is partially superimposed on the door frame (1) in the door's closed position so as to obtain a sealing between the door leaf and the door frame. In other embodiment, as shown, for example, in FIG. 2, the dimensions of the front panel (6) of the door leaf may be increased due to the metallic strips welded along its perimeter and equipped with sealing elements. In this embodiment, said strips are superimposed on the edges of the door frame (1) in the door's closed position in order to obtain the sealing. Said sealing element or elements may be comprised of rubber or other suitable elastic material capable of providing the sealing.

This door frame (1) also represents a structure having a front part (11) and a rear part (12), preferably made of hollow pipe sections with rectangular cross-section. Meanwhile, in different embodiments, each of the front (11) and the rear (12) parts of the door frame (1) may include more than one pipe section with different cross-sections, welded together, in order to provide the desired assembly rigidity. For example, FIG. 2 shows an embodiment where the front part of the door frame consists of two (11 and 11') welded together pipe sections with rectangular cross-section. In this case, between the front (11, 11') part and the rear part (12) of the door frame (1) there is also provided a layer of the refractory material (13), preferably of mullite silica cardboard, which creates a thermal break therebetween. Thus, the door assembly according to the present invention differs by providing the thermal break between all the elements of its front part, placed outside, and all the elements of its rear part, arranged from the room side.

The door assembly according to the present invention is preferably installed in the following manner. A first clamping frame (14) made of a metallic angular profile is welded to the metallic casing (3) of the door opening, so that one of the profile flanges bears against the casing (3), and the other profile flange protrudes inwards the door opening and forms a support lug. The assembled door frame (1) with the door leaf (2) is installed such that it abuts against this lug, and is fixed by welding a second clamping frame (15) made of a metallic angular profile to the casing (3), on the other side of the door frame (1). The second frame (15) is welded such that one of the profile flanges of the frame (15) bears against the casing (3), and the other flange protrudes inside the door opening, thereby creating a closure lug and ensuring fixation of the door frame (1) between said support and closure lugs, as shown in FIG. 2.

Then, during the described installation procedure of the door frame (1), between the door frame (1) and said support and closure lugs of the clamping frames (14 and 15), a layer of the refractory material (16), preferably of mullite silica cardboard, is interposed, wherein said layer forms a thermal break therebetween. It should be noted that the present invention is not limited in terms of choosing the refractory materials (9, 13, 16, 19), and in order to create thermal breaks in the door leaf, door frame and the fastening elements of the door assembly one can use any suitable refractory material or materials.

As can be seen in FIG. 2, in addition to the refractory material layer (16), between the support and the closure lugs of the clamping frames (14, 15) it is possible to place at least one additional fastening element, preferably made of hollow pipe sections with rectangular cross-section, similar to the stiffeners of the door assembly, in order to ensure the fastening security of the door frame (1) between said lugs.

In another embodiment of the present invention, the described door assembly is installed in the door opening having smaller dimensions than the door frame (1), as illustrated in FIG. 3, where in a plan view shown is a cross-section of a part of the door assembly and one of the walls of the door opening. For such installation procedure, a support frame (17) made of an angular profile is welded to the outer perimeter of the door frame (1), such that one of the profile flanges extends at a distance from the door frame surface on the inside of the door and is directed inwards the door opening, thereby forming a groove between said flange and the door frame (1). Then, the door frame is pressed against the wall of the opening such that said protruding profile flange of the support frame (17) abuts against the wall around the door opening. After that, channel-shaped metallic fastening elements (18) are mounted on the end faces of the door opening, at least from the upper and lateral sides of the opening, so that at each of said channels (18) the wall essentially bears against the respective end face of the opening, wherein one of the flanges encloses the wall of the opening from the inside, and other flange is fitted into said groove formed by the profile flange of the support frame (17) and the internal side of the door frame, as shown in FIG. 3. Moreover, a layer of the refractory material (19), preferably of mullite silica cardboard, is interposed between the wall of the opening and the surfaces of said channel (18) flanges and of the support frame (17), adjoining each other in the region of said groove, wherein said layer creates a thermal break therebetween. Next, said channel-shaped fastening elements (18) are welded together.

As mentioned above, the channel-shaped fastening elements (18) are installed on the end faces of the door opening, at least from the upper and lateral sides of the opening. This is caused by that the door opening can be delimited, from bellow, by the floor surface, where the installation of the fastening element is not required. However, the present invention is not limited in this regard, and the channel-shaped fastening elements (18) may be installed on the end faces of the wall from each side of the door opening. In the preferred embodiment, but not limited thereto, the channel-shaped metallic fastening elements (18) are made of two angular profiles and at least one metallic strip designed for connecting said profiles and welded thereto as shown in FIGS. 2 and 3. Due to the composed structure of these channels it is possible to decrease their weight and thus simplify the installation procedure of the door assembly.

The substantial advantage of the described method for installing the door assembly is that the mounting contour for the door frame, defined by the support frame (17), has dimensions that exceed the dimensions of the door opening. The use of such support frame (17) essentially removes all requirements for equipping the door opening for installing the door so that the door assembly according to the present invention may be installed essentially in any door opening.

Let's consider an explosion scenario outside the room where the described door assembly is installed. The air blast exposes from outside on the front panel (6) of the door leaf (2), respectively, and the load is carried by the front panel (6) and is transmitted, firstly, to the layer of the sheet refractory material (8). The refractory material (8) due to its porosity is pressed into the rigidly fastened grid support structure (5) and, therefore, some part of the air-blast is dissipated in the interior of the door. Concurrently, after the air blast exposure, the refractory material (8), due to flexibility, can restore its original position, thereby improving the door reliability as regards its tightness. Next, the rigid support structure (5) carries the major part of the excessive pressure and, thanks to the fact that it is designed as a grid, as described above, it ensures as high yield strength as possible. Meanwhile, the support structure (5) stabilizes the position of the porous internal part of the door leaf. Concurrently, the parts of the front panel (6) superimposed on the door frame in the door's closed position, as described above, transfer a part of the bending force form the air-blast exposure on the frame (1) of the door assembly, which is rigidly fixed in the opening by means of solid metallic clamping frames (14, 15) welded to the metallic casing (3) of the opening. That provides an additional relief of the structural elements of the door leaf, thereby reducing the risk of unrecoverable deformation of the whole assembly.

A door sample realized in accordance with the preferred embodiment of the fire-blast resistant door assembly, as described above, and installed in a test opening with a metallic casing according to the described embodiment of the method for installing the fire-blast resistant assembly, passed the blast resistance test and withstood the load level Pf=1.5 kg/sm$^2$ (150 kPa) without visual damages of the sample and impairment of functional properties, and without displacement when exploding the trinitrotoluene charge weighing 50 kg in a cube form on the ground surface from a distance of 12 m at the primary test, wherein at the secondary test the fire-blast resistant door withstood the load level of Pf=3.5 kg/sm$^2$ (350 kPa) from a distance of 9 m without changing the functional properties of the sample.

It should be noted that exemplary preferred embodiments of the present invention which have just been described, do not limit the scope of the present invention. Upon reading the present description the one skilled in the art may propose numerous modifications and supplements to the described embodiments, all of which would fall under the scope of patent protection defined by the appended claims of the invention.

The invention claimed is:

1. A fire-blast resistant door assembly comprising:

a door frame made of metal and designed to be installed in a door opening, a door leaf pivotally hinged in the door frame and having a front part and a rear part, characterized in that the front part of the door leaf comprises a metallic front panel and a front stiffener extending along the perimeter of the internal side of the front panel so as to form a closed loop that delimits a first mounting cavity, and a first refractory material disposed in the first mounting cavity, the rear part of the door leaf comprises a metallic rear panel and rear stiffener extending along the perimeter of the internal side of the rear panel so as to form a closed loop that delimits a second mounting cavity, and a metallic support structure mounted in the second mounting cavity, wherein the front and the rear parts of the door leaf are mutually connected by fastening the front and the rear stiffeners to each other such that said support structure abuts against said first refractory material, wherein a layer of a second refractory material is interposed between the front and the rear stiffeners, wherein said layer forms a thermal break between the front and the rear parts of the door leaf, and the door frame comprises a front part and a rear part, mutually connected through a layer of a third refractory material, forming the thermal break therebetween.

2. The fire-blast resistant door assembly according to claim 1, characterized in that said first refractory material is mineral basalt wool.

3. The fire-blast resistant door assembly according to claim 1, characterized in that at least one of the second refractory material and the third refractory material forming the thermal break in the door leaf and the door frame is mullite silica cardboard.

4. The fire-blast resistant door assembly according to claim 1, characterized in that the front and the rear stiffeners of the door leaf are made of hollow pipe sections with rectangular cross-section.

5. The fire-blast resistant door assembly according to claim 1, characterized in that said support structure is a grid made of horizontal and vertical elements.

6. The fire-blast resistant door assembly according to claim 5, characterized in that said horizontal and vertical grid elements of the support structure are hollow pipe sections with rectangular cross-section.

7. The fire-blast resistant door assembly according to claim 5, characterized in that said grid of the support structure has a constant vertical and/or horizontal spacing.

8. The fire-blast resistant door assembly according to claim 1, characterized in that the front and the rear stiffeners of the door leaf are fastened together by means of bolted connections.

9. The fire-blast resistant door assembly according to claim 8, characterized in that a number of bolted connections and/or the material of the bolts in said connections are defined so that the thermal effect on the external part of the door assembly, essentially is fully dissipated in the interior of the door assembly.

10. The fire-blast resistant door assembly according to claim 1, characterized in that the front panel of the door leaf is bigger, along its length and width, than the opening of the door frame and comprises a sealing element mounted along the perimeter of the internal edge of the front panel of the door leaf and providing a sealing between the door leaf and door frame in the door's closed position.

11. A method for installing the fire-blast resistant door assembly according to any of claims 1-10 in the door opening with a metallic casing, said method comprising the following steps:

welding a first clamping frame made of a metallic angular profile to the casing of the door opening so that one of the profile flanges bears against the casing, while the other profile flange forms a support lug, protruding inside the door opening, installing the door frame with the door leaf in the door opening so that the door frame abuts against said support lug, and welding a second clamping frame made of a metallic angular profile to the casing of the door opening so that one of the profile flanges bears against the casing, while the other profile flange forms a closure lug protruding inside the door opening, the door frame being fixed between said support and closure lugs, wherein during the installation of the door frame, a layer of the third refractory material is interposed between the door frame and said support and closure lugs, wherein said layer forms a thermal break therebetween.

12. The method for installing the fire-blast resistant door assembly according to any of claims 1-10 in the door opening having smaller size than the door frame of said assembly, said method comprising the following steps:

welding a support frame made of an angular profile to the exterior perimeter of the door frame so that one of the profile flanges extends at a distance from the door frame surface on the inside of the door and is directed inwards the door opening, so as to form a groove between said flange and the door frame, putting the door frame against the wall essentially so that said profile flange of the door frame, protruding from an internal side of the door frame with formation of the groove, abuts against a wall around the door opening, mounting channel-shaped metallic fastening elements on end faces of the door opening, at least from the upper and lateral sides of the opening, so that the wall of each of said channels essentially bears against a respective end face of the opening, wherein one of the flanges encloses the wall of the opening from the inside, while the other flange is fitted into said groove formed by the profile flange of the support frame and the internal side of the door frame, wherein a layer of the third refractory material forming a thermal break is interposed between the wall of the opening and the surfaces of said channel flanges and of the support frame, adjoining each other in the region of said groove, and welding said channel-shaped fastening elements together.

13. The method for installing the fire-blast resistant door assembly according to claim 12, characterized in that the channel-shaped metallic fastening elements consist of two angular profiles and at least one strip designed for connecting said profiles and welded thereto.

* * * * *